US007370647B2

(12) United States Patent
Thorneywork

(10) Patent No.: US 7,370,647 B2
(45) Date of Patent: May 13, 2008

(54) OVENS WITH CATALYTIC CONVERTERS

(75) Inventor: Nigel Thorneywork, Normandy (GB)

(73) Assignee: Merrychef Limited, Hampshire (GB)

( * ) Notice: Subject to any disclaimer, the term of this patent is extended or adjusted under 35 U.S.C. 154(b) by 0 days.

(21) Appl. No.: 10/624,988

(22) Filed: Jul. 22, 2003

(65) Prior Publication Data

US 2004/0163635 A1 Aug. 26, 2004

(30) Foreign Application Priority Data

Feb. 20, 2003 (GB) ..... 0303830.4

(51) Int. Cl.
*F24C 15/32* (2006.01)
*F24C 15/00* (2006.01)

(52) U.S. Cl. ..... 126/21 A; 126/21 R; 126/19 R; 219/400

(58) Field of Classification Search ..... 126/21 A, 126/21 R, 19 R; 219/393, 757, 681, 400; 422/179, 173, 174
See application file for complete search history.

(56) References Cited

U.S. PATENT DOCUMENTS 2,862,095 A * 11/1958 Scofield ..... 219/393
2002/0059930 A1 5/2002 Schmidmayer et al.

FOREIGN PATENT DOCUMENTS

DE 36 36 622 A1 5/1988
DE 3636622 A1 * 5/1988
DE 41 39 904 A1 6/1993
DE 4139904 A1 * 6/1993
FR 2705766 * 5/1993
GB 2349458 A * 11/2000
JP 55-43380 3/1980
JP 55-63329 * 5/1980
JP 55-11835 * 8/1980
JP 56-44536 4/1981
JP 56102625 8/1981
JP 59-202331 * 11/1984
JP 3-195826 8/1991
JP 4-210014 7/1992

OTHER PUBLICATIONS

UK Search Report dated Aug. 8, 2003 from cooresponding UK Patent Application Serial No. 0303830.4, (1pp.).

* cited by examiner

*Primary Examiner*—Alfred Basichas
(74) *Attorney, Agent, or Firm*—Ohlandt, Greeley, Ruggiero & Perle L.L.P.

(57) ABSTRACT

An oven comprises:
a cooking chamber defined by chamber walls;
a baffle plate mounted within the cooking chamber for directing the flow of air within the cooking chamber, said baffle plate being provided with at least one aperture;
a fan for moving air within the cooking chamber, and for maintaining a flow of air through said aperture; and
a catalytic converter located within the cooking chamber, characterized in that the catalytic converter is mounted both on said baffle plate and upstream of said fan.

9 Claims, 3 Drawing Sheets

OVENS WITH CATALYTIC CONVERTERS

BACKGROUND OF THE INVENTION

1. Field of the Invention

The invention relates to improvements in ovens with catalytic converters.

2. Description of the Prior Art

It is known to use catalytic converters in ovens in order to reduce the smoke output of ovens, particularly when the ovens are used to cook foods containing fat or grease which is likely to evaporate during the cooking process and cause smoke problems. For example, the present applicant's earlier International Patent Application No. PCT/GB00/04156 (WO 01/38798) describes an oven (2) having catalytic converters (38, 40) positioned outside of a cooking chamber (4). The catalytic converters (38, 40) are positioned downstream of grease filters (34, 36) and upstream of fans (26, 28) which are used to drive air out of the cooking chamber (4), along ducting (19), passed a heating element (20), and back into the cooking chamber (4) through perforations formed in the rear wall (10) of the cooking chamber (4). The grease filters (34, 36), catalytic converters (38, 40) and fans (26, 28) are all located outside of the walls of the cooking chamber (4).

German patent DE 3,636,622 describes an oven in which air is drawn through the centre of a baffle plate (3) by a fan (7), and forced outwardly through a concentric heating element (8) which is provided with strips (9) which are provided with a catalytic coating in order to reduce the smoke and odour content of the air. The strips (9) are connected to the heating element 8 so that they reach the temperature required to achieve the catalytic effect. The air then passes around the edges of the baffle plate (3) and back into the cooking chamber. It will be noted that the catalytic converter strips (9) are therefore located downstream of both the fan (7) and the heating element (8).

German patent DE 4,139,904 shows an oven having a similar arrangement. A fan (6) is used to draw air from a cooking chamber through the centre of a baffle plate (4), and to force the air outwardly through a concentric heating element (7) and then through a concentric catalytic converter (8). The catalytic converter (8) is formed from a porous sponge-like wire mesh on which a catalyst is deposited as a coating. The air then passes back around the edges of the baffle plate (4) into the cooking chamber. It will again therefore be noted that the catalytic converter (8) is located downstream of the fan (6) and heating element (7).

The invention seeks to provide an improved oven having a catalytic converter, which overcomes at least some of the disadvantages of the prior art.

SUMMARY OF THE INVENTION

In accordance with the invention there is provided an oven that comprises a cooking chamber defined by chamber walls. A baffle plate is mounted within the cooking chamber for directing the flow of air within the cooking chamber. The baffle plate includes at least one aperture. A fan moves air within the cooking chamber and maintains a flow of air through the aperture. A catalytic converter is located within the cooking chamber and is mounted both on the baffle plate and upstream of the fan. A grease filter is mounted on the upstream side of the catalytic converter.

BRIEF DESCRIPTION OF THE DRAWINGS

The invention will now be more particularly described, by way of example only, with reference to the following drawings, in which.

DESCRIPTION OF THE PREFERRED EMBODIMENT

Figure 1:
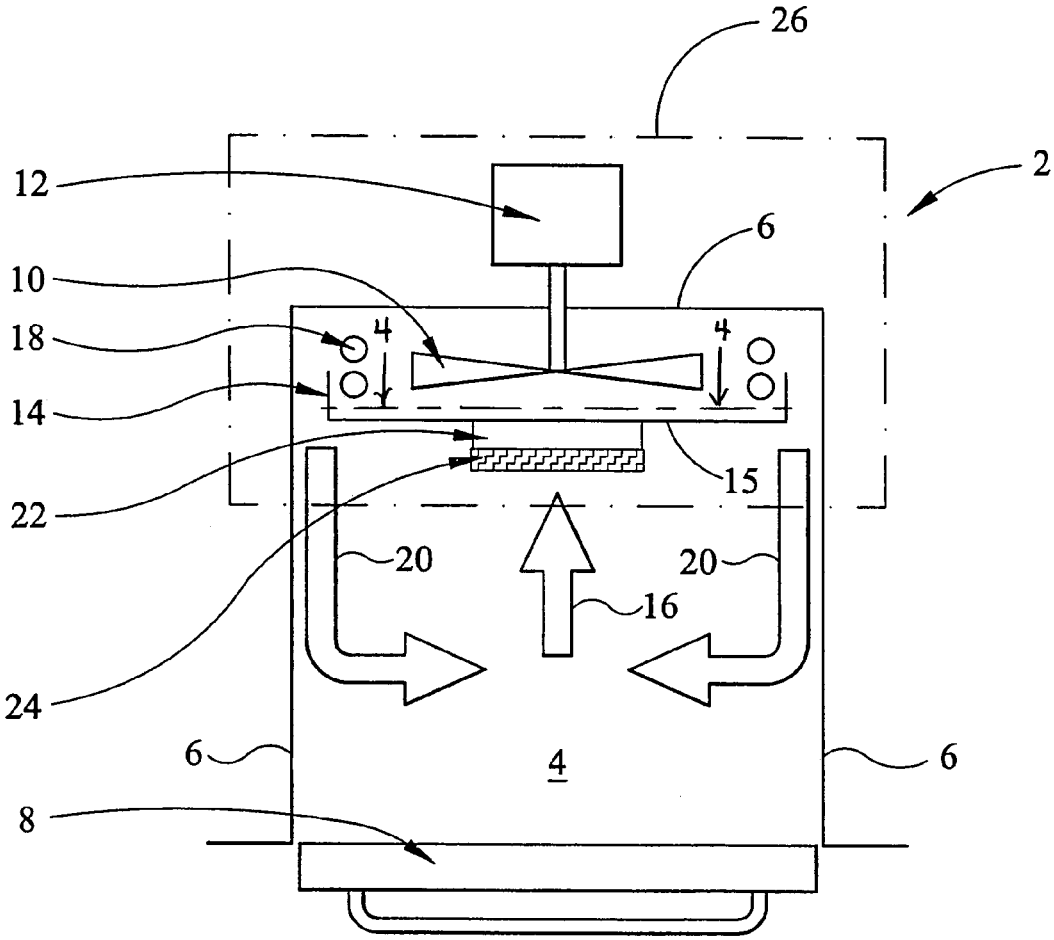
FIG. 1 shows a first embodiment of an oven in accordance with the invention.

Referring to FIG. 1, there is shown an oven 2 having a cooking chamber 4 defined by chamber walls 6 and a hinged door 8.

Figure 4:
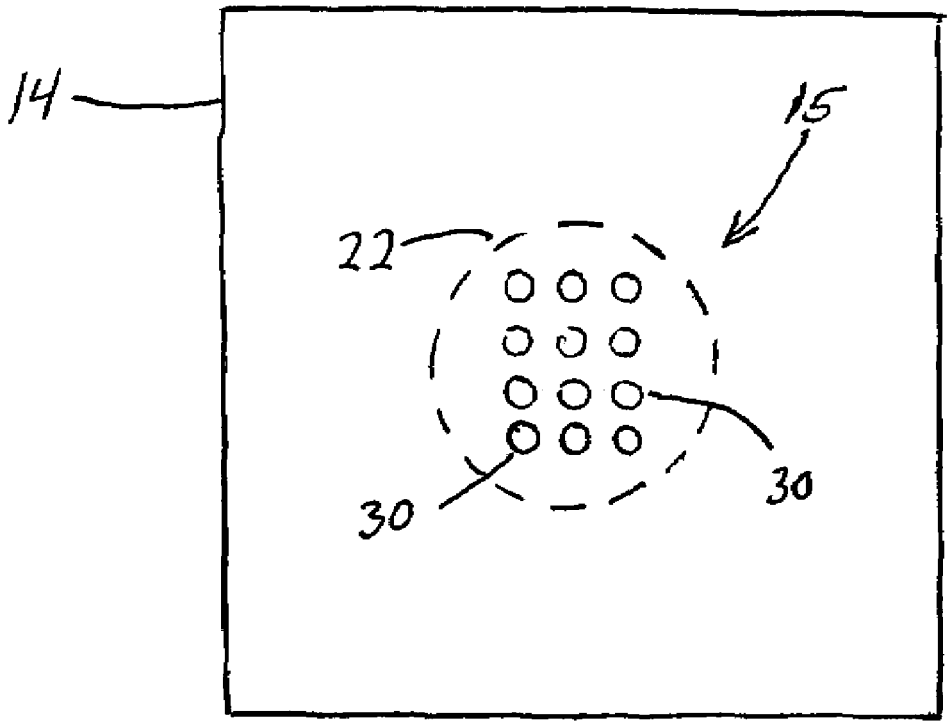
FIG. 4 shows a view taken along line 4 of FIG. 1.

The oven 2 is also provided with a fan 10 driven by an electric motor 12. Referring also to FIG. 4, the fan 10 draws in air through perforations 30 in the centre of a baffle plate 14, as indicated by air-flow arrow 16.

The air is then driven outwardly through a heating element 18, and then passes around the edges of the baffle plate 14 and back into the main area of the cooking chamber 4, as indicated by air-flow arrows 20.

It will be appreciated that a function of the baffle plate 14 is to ensure a proper air-flow around the cooking chamber 4, as indicated by arrows 16 and 20. The baffle plate 14 does not form part of the walls 6 of the cooking chamber 4, but is instead mounted within the cooking chamber 4 by suitable supports (not shown). The baffle plate 14 of course also serves to protect the user from contact with the fan 10 and the cooking element 18. The use of baffle plates for these purposes is of course already known, and such baffle plates are used in existing ovens.

However, the oven of FIGS. 1 and 4 is also provided with a catalytic converter 22 which is mounted, by any suitable means (including screws or nuts and bolts), on the upstream face of the baffle plate 14 so as to cover at least some (and preferably all) of the perforations 30 in the baffle plate 14.

The positioning of the catalytic converter 22 in this location was the result of a realization by the applicant that a much thinner catalytic converter could be successfully used than had previously been the case. This resulted from experimentation carried out by the applicant. In fact, the thickness of the catalytic converter 22 used in the oven of FIG. 1 is only about 2 cm (measured in a direction perpendicular to the main central portion 15 of the baffle plate 14).

In addition, a grease filter 24 is mounted, again by any suitable means, on the upstream side of the catalytic converter 22 in order to remove any large particles of grease which are present in the air before the air reaches the catalytic converter 22.

It will be appreciated that a number of advantages follow from the positioning of the catalytic converter 22 and grease filter 24 in the oven of FIG. 1, and these are described below.

Firstly, the fact that the catalytic converter 22 and grease filter 24 are located upstream of the fan 10 and heating element 18 results in a reduction in the build up of grease on the fan 10 and the heating element 18 themselves. These components therefore require less frequent cleaning and can be expected to last longer.

Secondly, the fact that the catalytic converter 22 and grease filter 24 are mounted on the front of the baffle plate 14 makes it easier to replace these components, because access to these components can be readily obtained via the hinged oven door 8. This is in contrast to the arrangements described in the two German patents mentioned above, in which replacement of the catalytic converter requires removal of the baffle plate. It is also in contrast to the arrangement described in PCT/GB00/04156 mentioned above, in which access to the grease filters and catalytic converters cannot be obtained from within the oven cavity, and access to these components therefore involves stripping down of the outer part of the oven.

Thirdly, the position of the catalytic converter 22 and grease filter 24 is ideally suited to the retro-fitting of these components to existing ovens. The retro-fitting of these components to existing ovens, which arises from the realization that these components can be successfully placed in the locations shown in FIG. 1, results in a considerable cost saving. Rather than replacing ovens of this type which have an unsatisfactory smoke output, such ovens can be converted to ovens having a much lower smoke output.

Figure 2:
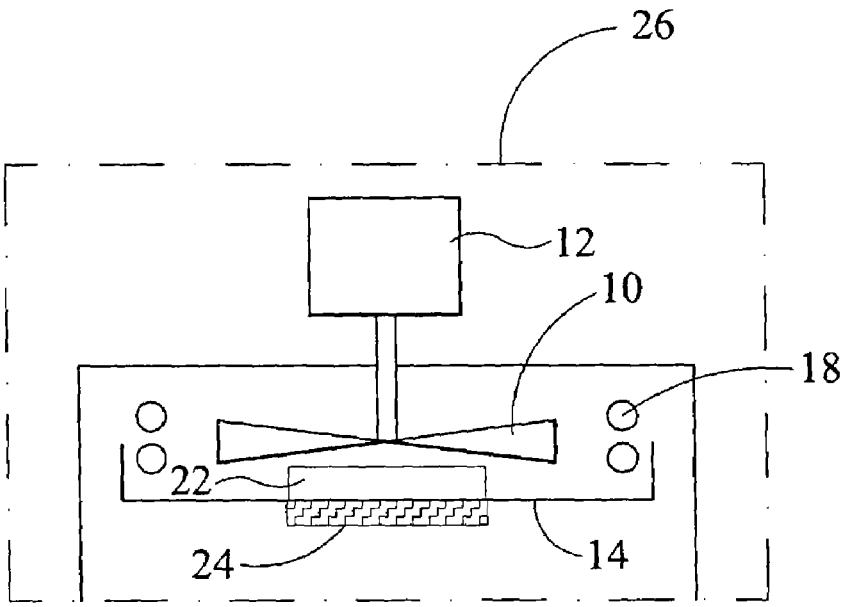
FIG. 2 shows a second embodiment of an oven in accordance with the invention.
Figure 3:
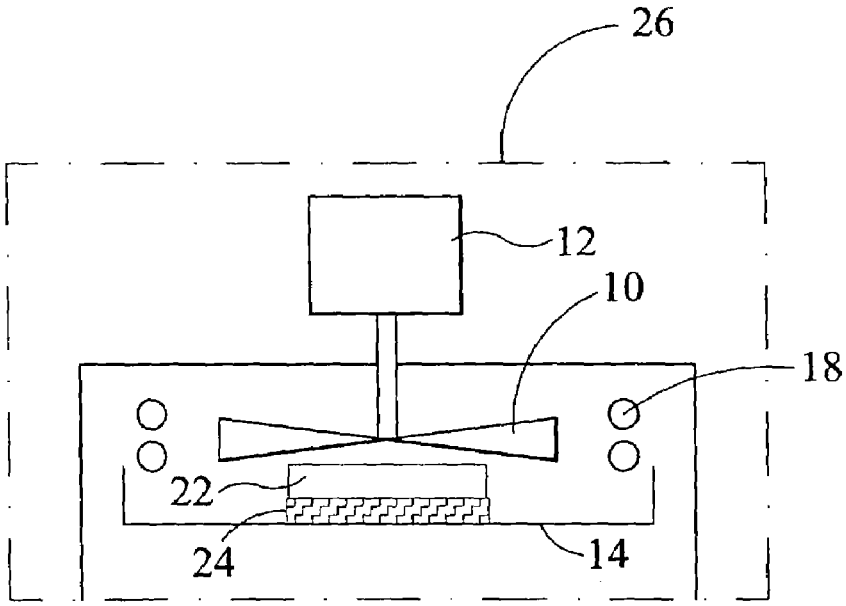
FIG. 3 shows a third embodiment of an oven in accordance with the invention.

FIGS. 2 and 3 show alternative embodiments of the oven of FIG. 1. For simplicity FIGS. 2 and 3 show only that part of the oven which is contained within the dashed line box 26 shown in FIG. 1, and also shown in FIGS. 2 and 3. In FIGS. 2 and 3 components which are the same as those of the oven of FIG. 1 are shown by the same reference numerals.

In FIG. 2 the catalytic converter 22 is mounted to the downstream face of the baffle plate 14, and the grease filter 24 is mounted to the upstream face of the baffle plate 14.

In FIG. 3 both the catalytic converter 22 and the grease filter 24 are mounted downstream of the baffle plate 14. The catalytic converter 22 is mounted to the downstream face of the baffle plate 14, and the grease filter 24 is mounted on the downstream side of the catalytic converter 22.

In FIG. 1 the air-flow arrows 20 show the air flowing around the two opposite side edges of the baffle plate 14. It should be appreciated that these air-flow arrows are for illustration only, and in the case of a rectangular baffle plate the air may flow around all four edges of the baffle plate, or around a different number of edges if appropriate.

In still further alternative embodiments, the oven 2 can be of any type, including a conventional electric or gas oven, a microwave combination oven, or a microwave oven (in which case the heating element 18 would not be present).

The invention claimed is:

1. An oven comprising:

a cooking chamber defined by chamber walls;

a baffle plate supported in said cooking chamber to define a cooking area and a fan area so that a space is provided between at least two opposite edges of said baffle plate and said chamber walls, said baffle plate comprising a plurality of perforations;

a catalytic converter mounted to an upstream face of said baffle plate to cover all of said perforations;

a grease filter mounted on an upstream side of said catalytic converter; and a fan disposed in said fan area to circulate air between said cooking area and said fan area via said space, said grease filter, said catalytic converter, said perforations and said fan, wherein cooking byproducts entrained in the air in said cooking area are substantially removed by said grease filter and said catalytic converter before the air exits said cooking area via said perforations and do not contaminate said fan.

2. An oven as claimed in claim 1, further comprising a heating element located downstream of said fan.

3. An oven as claimed in claim 1, further comprising a microwave heating means.

4. An oven as claimed in claim 1, wherein said baffle plate is rectangular and is arranged so that said space is between all four edges of the baffle plate and said chamber walls.

5. An oven as claimed in claim 1, wherein said baffle plate is positioned for air to flow from said fan area around said opposite edges into said cooking area and to return to said fan area via said grease filter, said catalytic converter and said perforations.

6. The oven of claim 1, wherein said cooking byproducts comprise grease and smoke.

7. The oven of claim 6, wherein said catalytic converter has a thickness of about two centimeters.

8. The oven of claim 1, wherein said catalytic converter and said grease filter are located within said cooking area.

9. An oven comprising:

a cooking chamber defined by chamber walls;

a baffle plate supported in said cooking chamber to define a cooking area and a fan area so that a space is provided between at least two opposite edges of said baffle plate and said chamber walls, said baffle plate comprising a plurality of perforations;

a retrofit assembly mounted on a side of said baffle plate that faces said cooking area in a manner that covers all of said perforations, said retrofit assembly comprising a catalytic converter having first and second opposed surfaces and a grease filter mounted on said first surface of said catalytic converter, wherein said second surface of said catalytic converter faces said perforations; and a fan disposed in said fan area to circulate air between said cooking area and said fan area via said space, said grease filter, said catalytic converter, said perforations and said fan, wherein cooking byproducts entrained in the air in said cooking area are substantially removed by said grease filter and said catalytic converter before the air exits said cooking area via said perforations and do not contaminate said fan.

* * * * *